US006220360B1

(12) United States Patent
Connell et al.

(10) Patent No.: US 6,220,360 B1
(45) Date of Patent: Apr. 24, 2001

(54) DOWNHOLE BALL DROP TOOL

(75) Inventors: Michael L. Connell, Duncan; James C. Tucker, Springer, both of OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 0 days.

(21) Appl. No.: 09/521,743

(22) Filed: Mar. 9, 2000

(51) Int. Cl.[7] ..... E21B 23/00; E21B 33/12; E21B 34/00; E21B 34/10

(52) U.S. Cl. ..... 166/373; 166/193; 166/318; 166/386

(58) Field of Search ..... 166/192, 193, 166/318, 332.4, 373, 386

(56) References Cited

U.S. PATENT DOCUMENTS 1,518,865 * 12/1924 McKissick ..... 166/318

4,491,177 * 1/1985 Baugh ..... 166/75.15

* cited by examiner

*Primary Examiner*—David Bagnell
*Assistant Examiner*—Jennifer M Hawkins
(74) *Attorney, Agent, or Firm*—Robert A. Kent; Anthony L. Rahhal

(57) ABSTRACT

A ball drop tool, for dropping a ball to a ball seat located in a tool, or tool string therebelow. The ball drop tool has an upper end adapted to be connected to the lower end of the coiled tubing string. The ball drop tool includes a housing with a ball drop cage positioned therein. The ball drop cage has a rocker arm pivotally attached thereto. The rocker arm can be pivoted so that a lower end thereof extends radially inwardly into an opening and will hold a ball in the cage. The cage will move downwardly in the housing until the lower end of the rocker arm is retracted from the opening, which will allow the ball to pass downwardly through the ball drop housing so that it can be received in a ball seat in a tool therebelow.

31 Claims, 4 Drawing Sheets

DOWNHOLE BALL DROP TOOL

BACKGROUND OF THE INVENTION

The present invention relates generally to a ball drop tool, and more particularly to a ball drop tool to be connected in a tool string lowered into a wellbore with coiled tubing.

In the drilling and completion of oil and gas wells, a wellbore is drilled into the subterranean producing formation or zone of interest. A string of pipe, e.g., casing, is typically then cemented into the wellbore. Oftentimes, a second string of pipe, commonly referred to as a liner, is attached at the lower end of the casing and extends further into the wellbore. Casing, when referred to herein, includes liners. A string of additional pipe, known as production tubing, is often lowered into the casing and/or the liner for conducting produced fluids out of the wellbore.

It is often necessary to lower downhole tools, such as packers or other tools into the casing, liner or production tubing to perform a desired operation. Many known downhole tools, such as but not limited to hydraulic disconnects, circulating subs and inflatable packers require a ball to be displaced down a tool string to engage a ball seat disposed in the tool. Typically, pressure is applied after the ball engages the seat to activate a mechanism in the tool. For example, with an inflatable packer, the ball may engage a seat to direct fluid into the inflatable elements of the packer, so that the packer will engage the casing, liner or production tubing. The foregoing are merely examples and there are a number of known tools that utilize and require a ball to engage a ball seat so that pressure can be applied in the tool above the seat to activate a mechanism in the tool string.

Coiled tubing is rapidly becoming a popular conveyance method for downhole tools, and the use of dropped balls to engage a seat in a tool lowered into the wellbore with coiled tubing is becoming more and more common. When coiled tubing is utilized to lower a tool into a wellbore, and it is necessary to drop a ball to engage a seat in the tool, the ball normally is manually inserted into the surface plumbing for the coiled tubing, so that the ball enters the coiled tubing at, or near the end of the tubing connected to the surface plumbing. The ball therefore enters the coiled tubing so that it must be pumped through the coiled tubing wraps on the reel, until it passes over a gooseneck which is utilized in connection with the coiled tubing. Pumping then continues for a period of time to insure that the ball has made its way through the coiled tubing to the seat in the downhole tool. Although such a method works in many circumstances, there are several drawbacks to this method.

The method described above for displacing a ball through coiled tubing is time-consuming and costly. It requires the usage of a large volume of fluid since at least one displacement volume of the coiled tubing is needed to get the ball around the wraps and to the downhole tool. Occasionally, balls are caught in the coiled tubing and never make it to the tool. For example, when small diameter balls are used in large coiled tubing, it is difficult to achieve a fluid velocity which will carry a small diameter ball through the wraps on the reel.

In addition, there are times when downhole devices above the ball seat have restrictions which would prevent a ball from passing therethrough to the ball seat in the tool. For example, filter screens are often run downhole to keep debris from plugging off small passages in the tools below. Actuating balls cannot pass through the screens. Likewise, it is possible that a tool having a small diameter would be positioned above the ball seat and thus would prevent the ball from passing therethrough. The present invention addresses the above needs by providing a downhole ball drop tool that can be positioned in the tool string below the coiled tubing and if necessary below any tools with restrictive diameters, and above the seat in the tool such that the ball does not have to pass through the coiled tubing wraps.

SUMMARY OF THE INVENTION

The present invention is a ball drop tool for use with coiled tubing which provides a method for dropping a ball into a downhole tool to engage a ball seat in the tool without the necessity of displacing the ball through the coiled wraps in a reeled coiled tubing. The ball drop tool comprises a ball drop housing having an upper end adapted for connection to a length of coiled tubing. The housing has a longitudinal opening therethrough and has a ball drop cage disposed therein. The ball drop cage has a closed upper end and an open lower end. A ball is disposed in the ball drop cage. A rocker arm having an upper end and a lower end is pivotally connected to the ball drop cage.

The ball drop tool may be connected to a lower end of the length of coiled tubing and lowered into the wellbore as part of a tool string having a ball seat therein. The ball drop tool has a retaining position and a releasing position. In the retaining position, the rocker arm is rotated such that a lower end of the rocker arm is positioned in an opening defined by the ball drop cage. The ball is trapped between the rocker arm and the closed upper end of the ball drop cage so that it cannot pass downwardly into the ball seat therebelow. The tool string can be lowered into a wellbore and once it has reached a selected location, fluid flow can be increased so that a flow, or pressure sufficient to begin to urge the ball drop cage downwardly in the ball drop housing is reached. The fluid will act on the upper cap and will also act on the balls through openings defined in the upper cap to cause the ball drop cage to begin to move downwardly in the ball drop housing. The rocker arm will pivot so that the lower end thereof is retracted from the opening defined by the ball drop cage. Once this occurs, the ball will be released and allowed to pass downwardly through the ball drop tool and into the tool having the ball seat disposed therein. Pressure can then be increased to activate any mechanism associated with the ball drop seat and ball.

Numerous objects and advantages of the invention will become apparent to those skilled in the art when the following detailed description of the preferred embodiment is read in conjunction with the drawings which illustrate such embodiment.

DESCRIPTION OF THE PREFERRED EMBODIMENTS

After a well has been drilled, completed and/or placed in production, it is often necessary to perform any number of procedures therein such as but not limited to perforating, setting plugs, setting cement retainers, spotting permanent packers and the like. Such procedures are often carried out by utilizing coiled tubing. Coiled tubing is a flexible tubing, which can be stored on a reel when not being used. When used for performing well procedures, the tubing is passed through an injector mechanism, and a well tool is connected to the end thereof. A variety of tools may be connected in a tool string lowered in the well on the coiled tubing, and very often one of the tools will have a ball seat for receiving an actuating ball. Once the ball has engaged the seat, pressure can be increased to activate a mechanism in the tool string. The use of dropped balls through coiled tubing, and the use of ball seats in connection with a variety of tools, including but not limited to hydraulic disconnects, inflatable packers, hydraulic setting tools and pressure firing heads is common and is well known.

The injector mechanism pulls the tubing from the reel, straightens the tubing and injects it through a seal assembly at the wellhead, often referred to as a stuffing box. Typically, the injector mechanism injects thousands of feet of the coiled tubing with the well tool connected at the bottom end thereof into the casing string or the production tubing string of the well. A fluid, most often a liquid such as salt water, brine or a hydrocarbon liquid, may be circulated through the coiled tubing for operating well tools or for other purposes. The coiled tubing injector at the surface is used to raise and lower the coiled tubing and the well tool or tools during the service procedure and to remove the coiled tubing and well tools as the tubing is rewound on the reel at the end of the procedure.

Presently, when a tool having a ball seat is lowered into the coiled tubing, the ball is inserted into the surface plumbing and must be circulated through some or all of the coiled tubing wraps on the reel, out the bottom end of the coiled tubing and into the tool and the ball seat. The present invention provides a method and apparatus for positioning a ball between the bottom end of the coiled tubing and the ball seat.

Figures 1, 5:
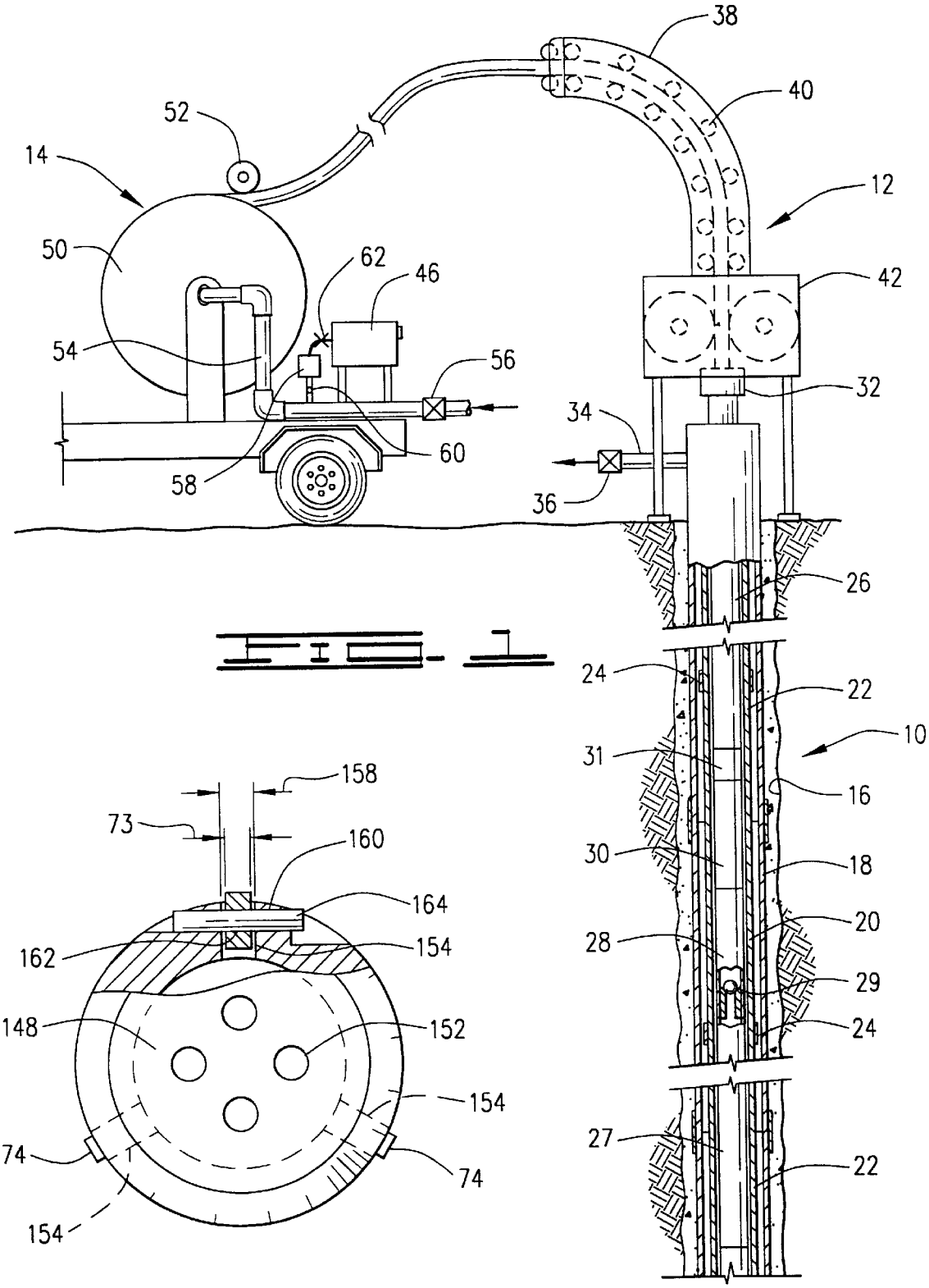
FIG. 1 is a schematic illustration of a cased well having a string of production tubing disposed therein and having a length of coiled tubing with a tool string including the downhole ball drop tool of the present invention inserted into the well by a coiled tubing injector and truck mounted reel.
FIG. 5 shows a partial section of the end view of the ball cage of the present invention.

Referring now to FIG. 1, a well 10 is schematically illustrated along with a coiled tubing injector 12 and a truck mounted coiled tubing reel assembly 14. Well 10 includes a wellbore 16 having a string of casing 18 cemented therein in the usual manner. A string of production tubing 20 is also shown installed in well 10 within casing string 18. Production string 20 may be made up of a plurality of tubing sections 22 connected by a plurality of joints or collars 24 in a manner known in the art.

A length of coiled tubing 26 is shown positioned in production tubing string 20. A tool string 27 including a downhole tool 28 is connected to coiled tubing 26. Tool 28 has a ball seat 29 therein for receiving a ball. The ball drop tool 30 of the present invention is generally designated in FIG. 1 by the numeral 30. Ball drop tool 30 may be connected to the lower end of coiled tubing 26 with an adapter 31 or other tool or joint connector. Other well tools may be attached above or below tool 28.

Coiled tubing 26 is inserted into well 10 by injector 12 through a stuffing box 32 attached to the upper end of tubing string 20. Stuffing box 32 functions to provide a seal between coiled tubing 26 and production tubing string 20 whereby pressurized fluids within well 10 are prevented from escaping to the atmosphere. A circulating fluid removal conduit 34 having a shutoff valve 36 therein is sealingly connected to the top of casing string 18. Fluid circulated into well 10 through coiled tubing 26 is removed from the well through conduit 34 and valve 36 and routed to a pit, tank or other fluid accumulator.

Coiled tubing injector 12 is of a kind known in the art and functions to straighten coiled tubing 26 and inject it into well 10 through stuffing box 32 as previously mentioned. Coiled tubing injector 12 comprises a guide mechanism 38, commonly referred to as a gooseneck, having a plurality of internal guide rollers 40 therein and a coiled tubing drive mechanism 42 which is used for inserting coiled tubing 26 into well 10, raising the coiled tubing or lowering it within the well, and removing the coiled tubing from the well as it is rewound on reel assembly 14.

Truck mounted reel assembly 14 includes a reel 50 on which coiled tubing 26 is wound. A guide wheel 52 is provided for guiding coiled tubing 26 on and off reel 50. A conduit assembly 54 is connected to the end of coiled tubing 26 on reel 50 by a swivel system (not shown). A shutoff valve 56 is disposed in conduit assembly 54, and the conduit assembly is connected to a fluid pump (not shown) which pumps fluid to be circulated from the pit, tank or other fluid communicator through the conduit assembly and into coiled tubing 26. Typically if an actuating ball is to be dropped without the use of the ball drop tool 30 of the present invention, the ball may be inserted in the piping between the coiled tubing and the shutoff valve 56. Balls may also be introduced upstream of the valve and pumped therethrough. In either case, balls introduced in this manner must pass through the wraps of coiled tubing on the coiled tubing reel.

A fluid pressure sensing device and transducer 58 may be connected to conduit assembly 54 by connection 60, and the pressure-sensing device may be connected to a data acquisition system 46 by an electric cable 62. As will be understood by those skilled in the art, data acquisition system 46 may function to record the surface pressure of fluid being pumped through the coiled tubing. Other known methods may also be used to record fluid pressure.

Referring now to FIGS. 2–5, the details of ball drop tool 30 will be discussed. Ball drop tool 30 which may also be referred to as a ball drop assembly 30, comprises a ball drop housing 70 having a ball drop cage 72 movably disposed therein. Ball drop cage 72 has a central opening 69 defined by a bore 71. Ball drop tool 30 has at least one, and preferably three rocker arms 74. Rocker arms 74 are pivotably connected to ball drop cage 72. Each rocker arm 74 has a thickness 73 and a length 75.

Figure 2:
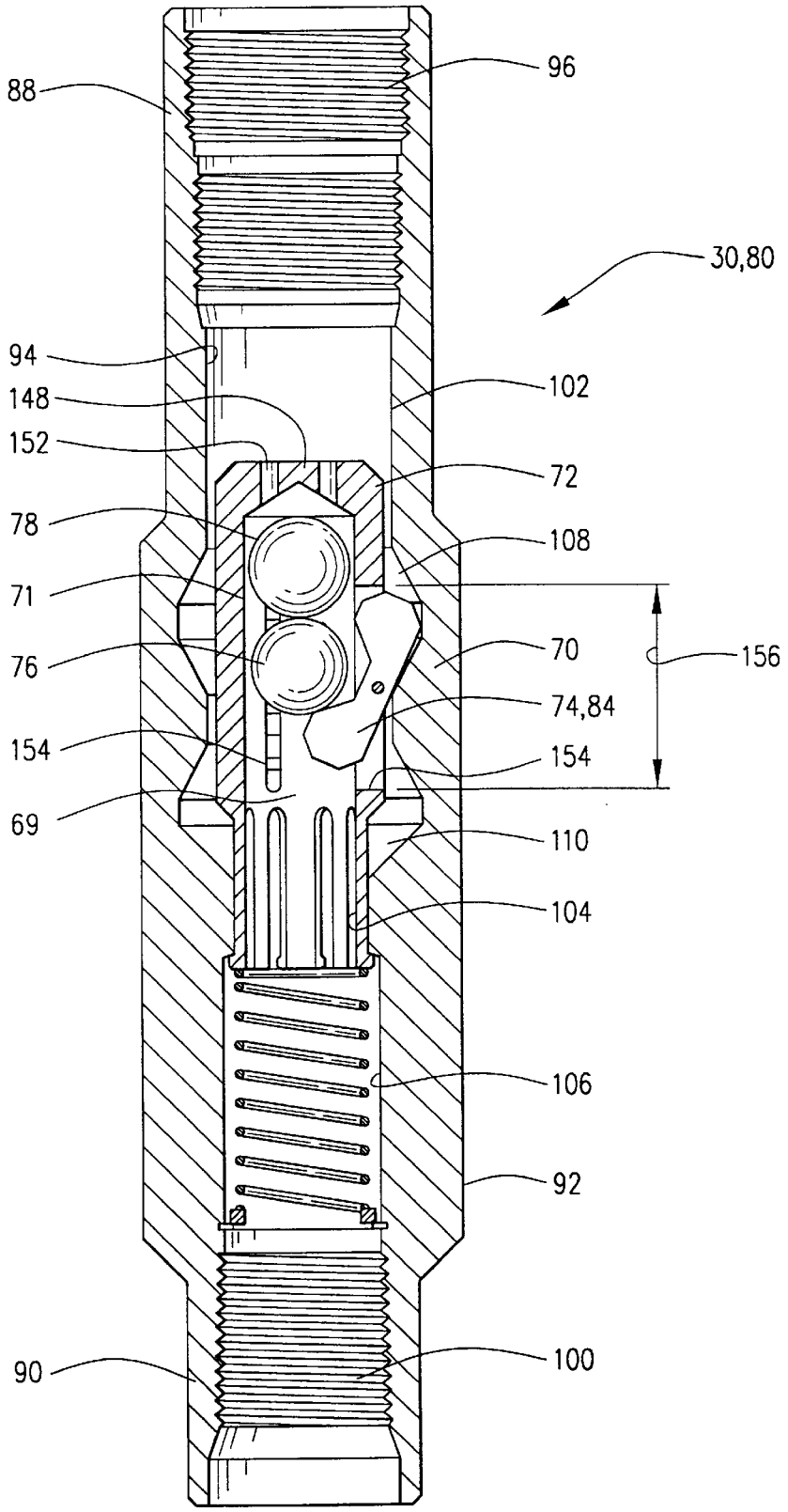
FIGS. 2, 3 and 4 show cross sections of the ball drop tool of the present invention in different positions having actuating balls disposed therein.
Figure 3:
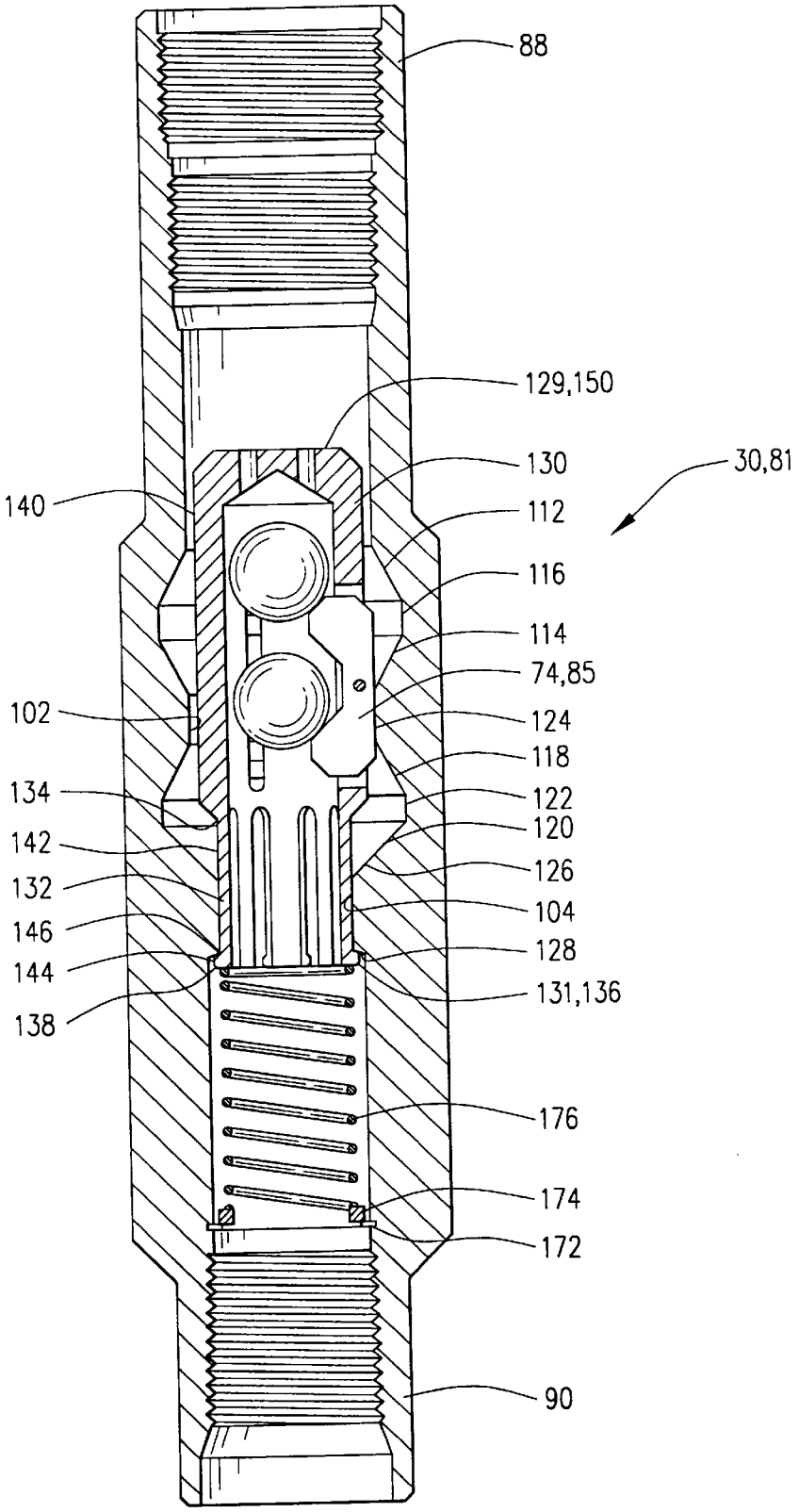
Figure 4:
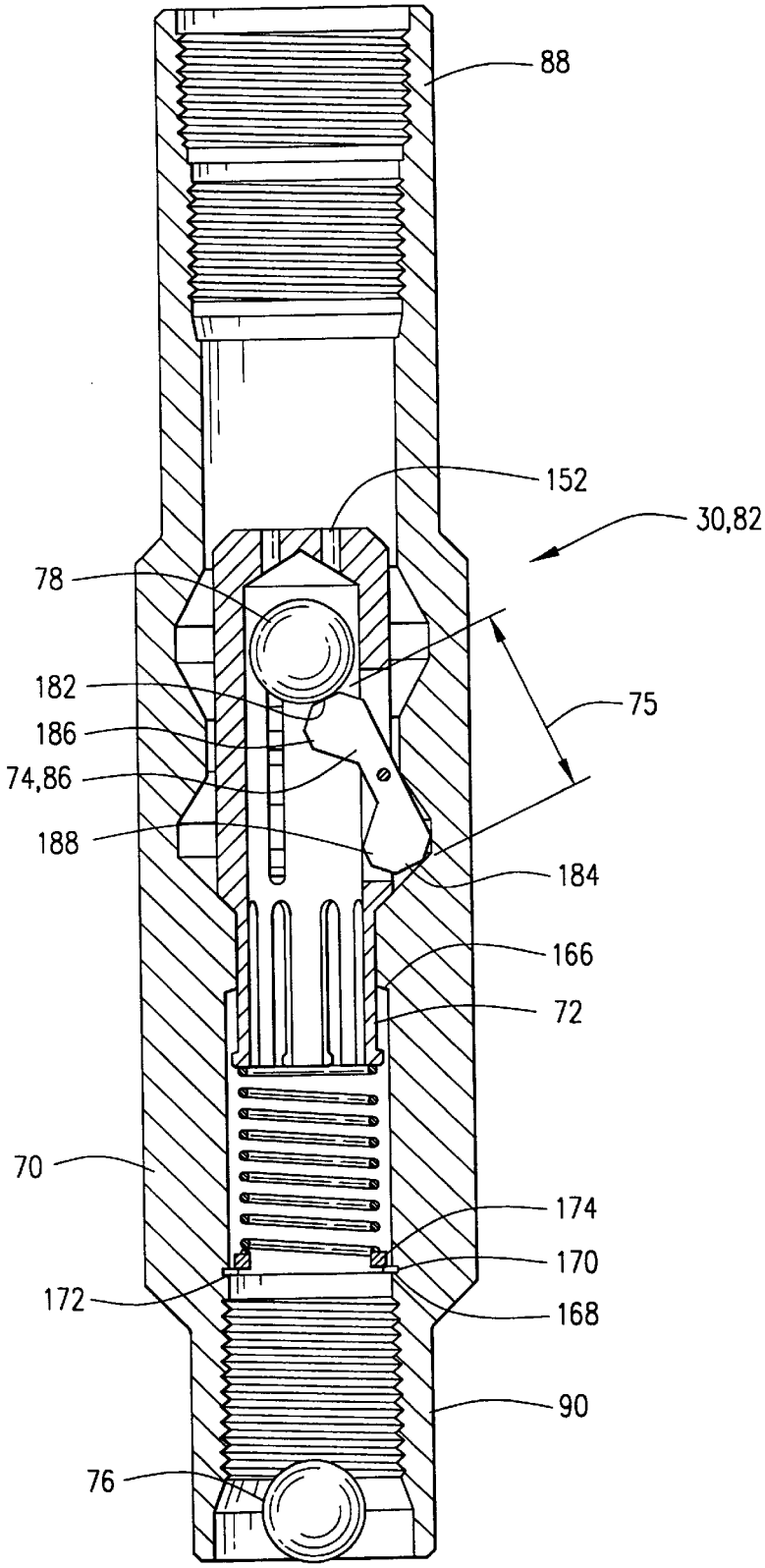

The ball drop assembly 30 of the present invention may be utilized with one or more balls, and the embodiment shown in FIGS. 2–4 has two actuating balls comprising a first or lower ball 76 and a second or upper ball 78. In the embodiment shown, ball 76 is smaller than ball 78. Balls of the same size may be used depending on the configuration of the tool and the ball seats to be utilized. Additional balls could be added simply by lengthening the tool 30 and placing balls therein. Ball drop cage 72 is movable from a retaining position 80, which may be referred to as a first retaining position shown in FIG. 2, to a releasing position 82 as shown in FIG. 4. The position shown in FIG. 3 may be referred to as a second retaining position 81. Rocker arm 74 has corresponding first and second retaining positions 84 and 85 as seen in FIGS. 2 and 3 and a releasing position 86 as shown in FIG. 4.

Housing 70 has an upper end 88, a lower end 90, an outer surface 92 and an inner surface 94. Threads 96 are defined on inner surface 94 at the upper end of housing 70. Housing 70 is thus adapted to be connected to the lower end of coiled tubing 26 with an adapter, joint or other tool which may be connected to ball drop assembly 30 at threads 96 and connected to coiled tubing 26, thus connecting ball drop assembly 30 to coiled tubing 26. Threads 100 are defined on the inner surface 94 of housing 70 at the lower end thereof and so that tool 30 may be connected to a tool, joint, or other threaded member therebelow. Ball drop assembly 30 is therefore adapted to be connected to the lower end of coiled tubing 26 and to be connected in tool string 27.

Housing 70 has a first bore 102, a second bore 104 and a third bore 106. Second bore 104 has a smaller diameter than first bore 102 and is positioned radially inwardly therefrom. Third bore 106 has a diameter greater than second bore 104 and less than first bore 102. Third bore 106 is thus positioned radially outwardly from second bore 104 and radially inwardly from first bore 102. First or upper and second or lower cavities 108 and 110 respectively are defined in first bore 102. First cavity 108 has first or upper and second or lower angular sides 112 and 114 connected by a base or flat portion 116. Second cavity 110 is defined by first or upper and second or lower angular sides 118 and 120 connected by a flat or base portion 122 therebetween. Cavities 108 and 110 are spaced apart from one another in bore 102 such that they define a flat or fulcrum portion 124. Fulcrum portion 124 defines a portion of bore 102. Angular side 120 extends radially inwardly to bore 104 and thus may include an angular transition portion 126. A downward facing shoulder 128 is defined by and extends between second and third bores 104 and 106 respectively.

Ball drop cage 72 has an upper end 129, a lower end 131, and essentially comprises a collet comprising a collet body 130, and a plurality of collet fingers 132 having a first end 134 and a second end 136 extending therefrom. Upper end 129 is closed to prevent balls disposed therein from passing upwardly in the tool. Lower end 131 is open to allow the passage of balls therethrough. A plurality of collet heads 138 are defined at second end 136 of collet fingers 132. Preferably, ball drop cage 72 comprises eight collet fingers. A first outer or collet body diameter 140 is defined on collet body 130. Collet fingers 132 define a collet finger, or second outer diameter 142 positioned radially inwardly from first outer diameter 140. Collet heads define a collet head diameter or third outer diameter 144 which extends radially outwardly from second or finger outer diameter 142. An upward facing shoulder 146 is defined by and extends between second and third outer diameters 142 and 144 on ball drop cage 72. A cap 148 is defined at the upper end 150 of collet body 130 which also comprises upper end 129 of ball drop cage 72. Cap 148 has a plurality of openings 152 defined therein for allowing flow therethrough.

Slots 154 are defined in collet body 130 for receiving rocker arms 74. A width 156 and length 158 of slot 154 are greater than thickness 73 and length 75 of rocker arms 74. Openings 160 are defined in collet body 130 and intersect slots 154. Rocker arms 74 have openings 162. Openings 160 and 162 are for receiving pins, which are preferably self-locking pins 164. Rocker arms 74 are thus pivotably attached to ball drop cage 72, and preferably to the collet body portion 130 thereof.

Referring now to FIG. 2, ball drop cage 72 is received in ball drop housing 70 such that collet heads 138 are positioned in third bore 106. Third bore 106 has an upper end 166 which is defined by shoulder 128 and a lower end 168. A groove 170 is defined in bore 106 at the lower end thereof and has a retaining ring 172 received therein. A washer 174 is disposed in bore 106 and rests on retaining clip 172. A spring 176 is disposed in bore 106 and, as shown in FIG. 2, engages washer 174 and collet heads 138. Spring 176 thus biases ball drop cage 72 upwardly so that the collet heads 138 engage shoulder 128 to hold ball drop cage 72 in its first retaining position 80.

Rocker arms 74 have a first or upper ends 182 and second or lower ends 184. A first, or upper radially inwardly extending foot 186 is disposed at upper end 182 and a second or lower radially inwardly extending foot 188 is disposed at lower end 184 of each rocker arm 74. In retaining position 80, rocker arms 74 are rotated such that lower ends 184 thereof are rotated into opening 71 and engage first or lower ball 76. Upper ends 182 of rocker arms 74 are rotated radially outwardly and are received in upper cavity 112.

The operation of the invention is apparent from the drawings. Coiled tubing 26 is passed through tubing injector 12. Tool string 27 which includes ball drop tool 30 is connected to the lower end of coiled tubing 26. Ball drop tool 30 may be connected to the lower end of coiled tubing 26 with an adapter, joint or other tool or threaded connection therebetween. Ball drop tool 30 is thus positioned between the end of coiled tubing 26 and ball seat 29 disposed in downhole tool 28, which is also connected in tool string 27. Ball drop tool 30 is lowered into the well, along with the remainder of tool string 27 until a selected location in the well is reached. If desired, fluid may be circulated through the tool since ball drop tool 30 allows flow therethrough around ball drop cage 72 and through openings 152.

Once the selected location is reached, flow rate can be increased to a sufficient rate such that the pressure acting across cap 148 of ball drop cage 72 and the balls will overcome the force of spring 176 and urge ball drop cage 72 downwardly. The increase in flow rate will act on the balls which will cause rocker arms 74 to pivot to the position shown in FIG. 3 which is referred to as second retaining position 81 since the actuating balls will not be released in that position. Continued flow will cause cage 72 to slide downward. Flat 124 acts similarly to a fulcrum, so that as cage 72 continues to slide downward, rocker arms 74 will pivot about pin 164 and rotate about flat 124 until lower foot 188 rotates radially outwardly and is received in lower cavity 110 as shown in FIG. 4. First ball 76 is released and fluid flow therein will displace ball 76 downwardly until it reaches ball seat 29. Ball drop cage 72 and rocker arm 74 can thus be referred to as a hydraulically actuated releasing means. Once ball 76 reaches seat 29, pressure in the tool string can be increased to activate a desired mechanism associated with the ball seat, including those set forth above, or any other tool or mechanism that requires an increase in pressure, or a redirection of flow caused by a ball engaging a ball seat.

As is apparent from FIG. 4, which shows the sleeve in its releasing position, if a second or more balls are utilized, the balls are prevented from flowing downwardly by upper end 182 of rocker arm 74. Once flow is slowed, or stopped to decrease pressure in the tool string, spring 176 will urge ball drop cage 72 back to its retaining position and, if a second ball is being utilized such as ball 78, the ball will then take the position which was occupied by first ball 76 as shown in FIG. 2 and is ready to be dropped.

If a second ball is used, it may be necessary to increase the pressure to a sufficient amount to discharge the first ball and the first ball seat from the tool string or to open additional flow ports to allow flow through the tool so that the cage 72 can be moved to its releasing position. A second ball seat in the tool string can then be engaged by second ball 180. Because first ball 76 is preferably smaller than ball 78, it can pass through the seat which will be engaged by ball 78. Once the first ball and ball seat have been removed or flow ports opened, flow can then be decreased so that cage 72 moves to its first retaining position 80 and is ready to drop second ball 78. To drop second ball 78, the process is simply repeated and flow is increased to move the cage from retaining position 80 to releasing position 82 and to displace the ball 78 downwardly until it is received in a second ball seat. Once second ball 78 engages the second ball seat, pressure can again be increased to activate a mechanism associated with the second ball seat.

Although ball drop tool 30 is shown disposed in a production tubing, it is apparent that the tool can be utilized in production tubing, or in the casing itself. It will be seen, therefore, that the ball drop tool of the present invention is well adapted to carry out the ends and advantages mentioned, as well as those inherent therein. The invention can be utilized with any tool which requires that a ball be dropped to engage a ball seat therein and is not limited by any of the specific examples provided. While presently preferred embodiments of the apparatus have been described for the purposes of this disclosure, numerous changes in the arrangement and construction of parts may be made by those skilled in the art. All such changes are encompassed within the spirit and scope of the appended claims.

What is claimed is:

1. A method of dropping a ball through a tool string to engage a ball seat located in a downhole tool, the method comprising:

(a) providing said tool string with said downhole tool;

(b) placing an actuating ball in said tool string above said ball seat;

(c) lowering said tool string, including said actuating ball into a wellbore with coiled tubing; and (d) releasing said ball after said tool string has been lowered so that it engages said ball seat.

2. The method of claim 1 wherein said placing step comprises releasably positioning said actuating ball in said tool string above said ball seat.

3. The method of claim 1 wherein said releasing step comprises:

displacing fluid into said tool string at a selected flow rate to cause said actuating ball to release and be displaced downwardly to said ball seat.

4. The method of claim 1, further comprising displacing a fluid through said tool string around said actuating ball prior to said releasing step.

5. The method of claim 1 wherein step (b) comprises placing first and second actuating balls in said tool string, said tool string having first and second ball seats below said actuating balls, and step (d) comprises releasing said first ball to engage said first ball seat, the method further comprising:

(e) increasing pressure in said tool string to activate a first mechanism operably associated with said first ball seat;

(f) after step (e), increasing said pressure to open a flow path through said tool string; and (g) releasing said second ball to engage said second ball seat.

6. The apparatus of claim 5 further comprising:

(h) increasing pressure in said tool to activate a second mechanism operably associated with said second ball seat after said second actuating ball engages said second ball seat.

7. The method of claim 1 further comprising:

(e) increasing pressure in said well to activate a mechanism operably associated with said ball seat after said actuating ball engages said ball seat.

8. The method of claim 1 wherein said placing step comprises:

placing said actuating ball in a ball drop housing; and threadedly connecting said ball drop housing in said tool string above said ball seat.

9. A method of actuating a mechanism in a downhole tool string, said downhole tool string having a ball seat for receiving an actuating ball, the method comprising:

releasably positioning said ball in said tool string between a lower end of a length of coiled tubing and said ball seat;

lowering said tool string into said well with said coiled tubing;

releasing said actuating ball so that it engages said ball seat; and increasing pressure in said tool string to actuate said mechanism.

10. The method of claim 9, wherein said releasing step comprising displacing fluid at a predetermined rate to cause said actuating ball to release to said ball seat.

11. The method of claim 9, said positioning step comprising:

providing a ball drop housing;

locating said actuating ball in said ball drop housing; and connecting said ball drop housing in said tool string between the lower end of said coiled tubing and said ball seat.

12. The method of claim 11, said ball drop housing having a ball drop cage for releasably retaining said actuating ball therein, said cage having a retaining position and a releasing position, said releasing step comprising moving said cage in said housing from said retaining to said releasing position to release said actuating ball.

13. The method of claim 12, said releasing step comprising hydraulically moving said cage to said releasing position.

14. A ball drop apparatus for use in a tool string lowered into a well, the tool string having a ball seat therein for receiving an actuating ball, the ball drop apparatus comprising:

an outer housing adapted to be connected in said tool string; and the actuating ball releasably disposed in said housing, said housing having a flow path therethrough for allowing flow around said ball when said ball is disposed therein.

15. The ball drop apparatus of claim 14, further comprising:

a ball drop cage disposed in said housing, said actuating ball being disposed in said ball drop cage, said cage having a cap at its upper end and having an open lower end and being movable from a retaining position wherein said ball is retained in said cage to a release position wherein said ball is released so that the ball can be displaced downwardly to said ball seat.

16. The apparatus of claim 15 wherein fluid flow through said housing at a selected rate causes said cage to move from its retaining to its release position.

17. The apparatus of claim 15 further comprising a rocker arm pivotally attached to said ball drop cage, wherein said rocker arm engages said actuating ball to retain said actuating ball when said cage is in its retaining position.

18. The apparatus of claim 17, wherein said rocker arm rotates to release said ball when said cage moves to its release position.

19. The apparatus of claim 15 wherein said cap has a plurality of openings for allowing flow therethrough.

20. The apparatus of claim 15, further comprising biasing means for biasing said cage to the retaining position.

21. The apparatus of claim 20, wherein said biasing means comprises a spring disposed in said housing below a lower end of said cage.

22. The apparatus of claim 21 wherein fluid is displaced at a sufficient rate into said outer housing to overcome a spring force of said spring to move said cage from said retaining to said release position.

23. The apparatus of claim 14 wherein said housing is adapted at upper and lower ends thereof to be threadedly connected in said tool string.

24. The apparatus of claim 14, said housing having first and second balls releasably disposed therein, wherein said first ball may be released and said second ball retained in said housing and released at a selected time thereafter.

25. The apparatus of claim 14, said ball being releasable in response to a flow of fluid through said ball drop tool.

26. The ball drop apparatus of claim 14, said outer housing adapted to be connected in said tool string below a lower end of a coiled tubing used to lower said tool string into said well.

27. A ball drop apparatus for use with a well tool lowered into a well on a length of coiled tubing, the tool having a ball seat receiving an actuating ball, the ball drop apparatus comprising:

a housing positioned between a lower end of said coiled tubing and said ball seat; and the actuating ball releasably disposed in said housing.

28. The apparatus of claim 27, wherein fluid flow through said housing at a selected flow rate releases said actuating ball from said housing.

29. The apparatus of claim 27 further comprising:

a ball cage movably disposed in said housing, said actuating ball being disposed in said cage, said cage being movable from a retaining position wherein said ball is retained in said cage and a release position wherein said actuating ball is released from said cage and passes through said housing to engage said ball seat.

30. The apparatus of claim 27, said housing and ball defining a flow path therebetween so that fluid may be circulated therethrough prior to said actuating ball being released.

31. The apparatus of claim 30, wherein increasing a fluid flow at a selected rate through said housing releases said actuating ball therefrom.

* * * * *